United States Patent [19]

Del Vecchio et al.

[11] Patent Number: 4,655,041

[45] Date of Patent: Apr. 7, 1987

[54] RATE OF CHANGE OF PRESSURE TEMPERATURE PROTECTION SYSTEM FOR A TURBINE

[75] Inventors: Richard J. Del Vecchio, Wellsville; James A. Gram, Andover, both of N.Y.

[73] Assignee: Dresser Industries, Inc., Dallas, Tex.

[21] Appl. No.: 820,617

[22] Filed: Jan. 21, 1986

[51] Int. Cl.[4] ..... F01K 21/00

[52] U.S. Cl. ..... 60/646; 340/588

[58] Field of Search ..... 340/626, 588, 589, 584, 340/604, 605, 627; 60/660, 664, 665, 667, 646, 657

[56] References Cited

U.S. PATENT DOCUMENTS

| | | | |
|---|---|---|---|
| 2,906,928 | 9/1959 | Klein | 340/589 |
| 3,024,657 | 3/1962 | Brown | 340/584 |
| 3,117,311 | 1/1964 | Lemaire | 340/589 |
| 3,750,134 | 7/1973 | Weisend | 340/626 |
| 3,991,603 | 11/1976 | Wonn et al. | 73/29 |
| 4,063,228 | 12/1977 | Eggenberger et al. | 340/626 |
| 4,240,077 | 12/1980 | Hughes et al. | 340/584 |
| 4,412,780 | 11/1983 | Collins et al. | 415/17 |
| 4,459,583 | 7/1984 | van der Walt et al. | 340/589 |
| 4,474,012 | 10/1984 | Chamberlain | 60/660 |

FOREIGN PATENT DOCUMENTS

| | | | |
|---|---|---|---|
| 0043068 | 4/1979 | Japan | 340/588 |

*Primary Examiner*—Michael J. Tokar
*Assistant Examiner*—Robert R. Raevis

[57] ABSTRACT

A method and apparatus for protecting a turbine from undesirable temperature and pressure variations wherein an acceptable range of actual pressure and temperature variations is established, a first alarm signal is generated only if the acceptable range is exceeded by actual temperature or pressure, a second signal is established representing an acceptable rate of change of said actual pressure or temperature and a second alarm is generated if the actual rate of change of pressure or temperature exceeds the acceptable range of pressure or temperature whereby the second alarm signal is produced only when the first alarm signal is generated. In addition, a third signal is established representing a maximum rate of change of pressure and a third alarm signal is generated if the actual rate of change of pressure or temperature exceeds the maximum rate of change of pressure or temperature whereby the third alarm signal is produced only when the first alarm signal is generated.

24 Claims, 9 Drawing Figures

RATE OF CHANGE OF PRESSURE TEMPERATURE PROTECTION SYSTEM FOR A TURBINE

BACKGROUND OF THE INVENTION

This invention relates to protection and control systems for steam turbines and in particular to a control system which establishes predetermined acceptable high and low limits of operating pressure and temperature for the inlet steam to the turbine. The system generates a first alarm signal if the pressure or temperature exceeds the predetermined acceptable range of operation, generates a second alarm signal if the rate of change of temperature or pressure, while outside the predetermined acceptable operating range, exceeds a predetermined acceptable rate of change and generates a third alarm signal if the rate of change of pressure or temperature, while outside the acceptable operating range, exceeds a predetermined maximum rate of change of pressure or temperature.

Steam turbines are designed to operate with a supply of steam produced by a boiler. During certain operating conditions, there is a risk that water may enter the steam turbine along with the steam. Water carryover is undesirable since the resulting mechanical vibrations and thermal shock may result in shortened life time of or immediate permanent damage to the steam turbine. Sudden changes in steam pressure may cause water carryover the prior art systems utilize various ways to attempt to control the steam pressure in order to avoid this condition.

Some prior art devices track pressure variations over extended periods of time which require control devices that are stable and drift-free. Other devices detect a reduction in steam pressure in the boiler at a rate exceeding some predetermined threshold value and then change the setting of a steam control valve in response to the detecting means to attempt to control steam pressure.

Accompanying rapid changes in pressure may be a rate of change of temperature. These changes of temperature create thermal stress such as wheels loosening and cases cracking, create distortion and internal misalignment and vibration.

However, there are reasonable ranges of variation of temperature and pressure which ought not to require monitoring and further there are certain rates of change of pressure and temperature which ought to be allowable without attempts to control the pressure and temperature through opening or closing of valves and the like. It is only when some normally acceptable or maximum predetermined rate of change of temperature or pressure is exceeded that danger may occur and the operator alerted.

Therefore, it would be desirable to have a control system in which, first, an acceptable range of variation of temperature and pressure is established so that any variations of temperature or pressure within that range would not be of any concern or called to the attention of the operator. Secondly, the rage of change of pressure or temperature should be monitored only outside that allowable range of operation and then a second alarm produced if the rate of change of temperature or pressure exceeds the predetermined allowable rate of change of pressure. Finally, there should be a predetermined maximum rate of change of pressure or temperature which, if exceeded, should produce a third alarm indicating that a dangerous condition is existing.

In each of these cases, the turbine would not be prematurely shut down or the operator unduly alarmed for acceptable variations in pressure and temperature. However, the operator would be appropriately alerted to a condition that required monitoring.

Thus, it is an object of the present invention to provide a turbine control system in which an acceptable range of variation of temperature and pressure is established and a first alarm produced only when said acceptable range is exceeded.

It is another object of the present invention to provide a second alarm signal only when said pressure or temperature is operating outside the acceptable range of variation and the rate of change of temperature or pressure exceeds a predetermined acceptable value.

It is still another object of the present invention to provide a third alarm signal only when the pressure and temperature are operating outside the acceptable range and when the rage of change of temperature or pressure exceeds a predetermined maximum rate of change.

SUMMARY OF THE INVENTION

Thus, the present invention relates to a steam turbine being driven from a source of inlet steam and a control system for protecting said turbine from undesirable pressure variations comprising means for establishing an acceptable range of actual pressure variation, means coupled to said acceptable pressure range establishing means for generating a first alarm signal only if said range is exceeded by said actual pressure, means for generating a second signal representing an acceptable rate of change of said actual pressure, and means coupled to said first alarm signal generating means and said second signal generating means for generating a second alarm when the actual rate of change of pressure exceeds said acceptable rate of change whereby said second alarm signal is produced only when said first alarm signal is generated.

The invention also relates to a steam turbine being driven from a source of inlet steam and a control system for protecting said turbine from undesirable temperature variations comprising means for establishing an acceptable range of actual temperature variation, means coupled to said acceptable temperature range establishing means for generating a first alarm signal only if said range is exceeded by said actual temperature, means for generating a second signal representing an acceptable rate of change of said actual temperature, and means coupled to said first alarm signal generating means and said second signal generating means for generating a second alarm when the actual rate of change of temperature exceeds said acceptable rate of change whereby said second alarm signal is produced only when said first alarm signal is generated.

The invention also relates to a method for protecting a steam turbine being driven from a source of inlet steam from undesirable steam pressure variations comprising the steps of establishing an acceptable range of pressure variations, generating a first alarm signal only if said acceptable range is exceeded by said actual pressure, generating a second signal representing an acceptable rate of change of said actual pressure, and generating a second alarm when the actual rate of change of pressure exceeds said acceptable rate of change of pressure whereby said second alarm signal is produced only when said first alarm signal is generated.

The invention also relates to a method for protecting a steam turbine being driven from a source of inlet steam from undesirable temperature variations comprising the steps of establishing an acceptable range of temperature variations, generating a first alarm signal only if said acceptable range is exceeded by said actual temperature, generating a second signal representing an acceptable rate of change of said actual temperature, and generating a second alarm when the actual rate of change of temperature exceeds said acceptable rate of change of temperature whereby said second alarm signal is produced only when said first alarm signal is generated.

BRIEF DESCRIPTION OF THE DRAWINGS

These and other objects of the present invention will be more fully explained in conjunction with the attached drawings in which.

DETAILED DESCRIPTION OF THE DRAWINGS

Figure 1:
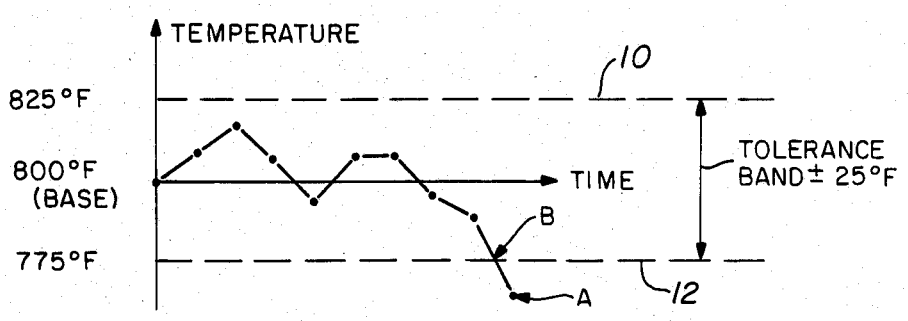
FIG. 1 is a graph illustrating temperature fluctuations of a steam turbine within an acceptable range of temperature variations and then exceeding the acceptable range.

It has been determined that the temperature of the inlet steam to a turbine may vary over a certain range of temperature variations and still be acceptable to the operation of the turbine. Thus, as shown in FIG. 1, assuming the base temperature to be 800° F., it has been determined that that temperature may vary plus or minus 25° F. as indicated by dashed lines 10 and 12 without any damage to the operation of the turbine. Thus, lines 10 and 12 establish an acceptable range of temperature variation. Thus, the monitor of the present invention is not active as long as the temperature of the input steam lies within the acceptable range of temperature variation between lines 10 and 12. Once the temperature exceeds the tolerance band as at point B, the monitor is activated and starts timing. Five second intervals are used for timing the temperaturee readings whenever outside the tolerance band established by lines 10 and 12. Thus, five seconds later the temperature is monitored at point A to determine whether or not the temperature change is within an acceptable rate of change and further whether or not it is exceeding a predetermined maximum rate of change.

Figure 2:
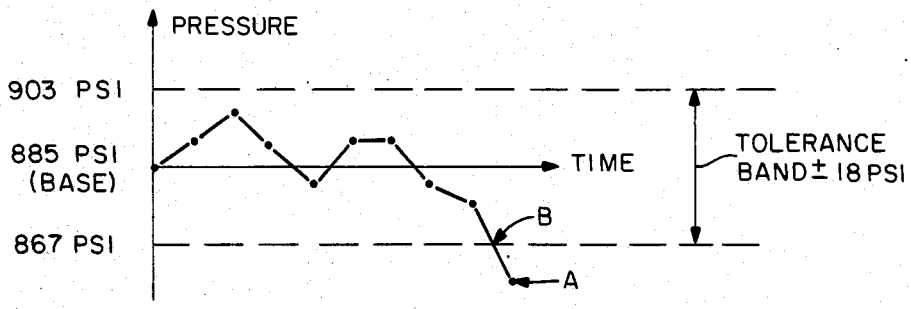
FIG. 2 is a graph similar to FIG. 1 except illustrating how pressure of the steam turbine may vary within an acceptable range of actual pressure variations and then exceed the acceptable range.

The same type of graph is illustrated in FIG. 2 for a pressure variation wherein the tolerance band is within plus or minus 18 psi. Here, however, once the pressure has exceeded the acceptable range of variation and the monitor is activated, readings are taken every 10 seconds to determine the rate of change of pressure.

Returning now to FIG. 1, the rate of change of temperature will be calculated from point B and compared with an acceptable rate of change which has been determined to be 25° F. over a 15 minute period. If the temperatures remain outside the acceptable range of temperature variation (outside lines 10 and 12) but within the acceptable rate of change of 25° F. over a 15 minute period, the alarms are inactive. However, if the rate of change exceeds the acceptable rate, an alarm will sound. In addition, a maximum permissible rate of change of temperature has been established as 37° to 40° F. over a 15 minute period. If the temperature change exceeds that predetermined maximum rate of change, a third alarm will sound.

Thus, three alarms are sounded in this system. The first alarm sounds when the temperature exceeds the predetermined acceptable range of temperature variation at this time the monitor is activated. The second alarm sounds if, and only if, the temperature exceeds the predetermined acceptable range and the rage of change of temperature exceeds a predetermined acceptable rate of 25° F. over a 15 minute period. The third alarm sounds if, and only if, the temperature is outside the predetermined acceptable range and the temperature rate of change exceeds a predetermined maximum rate of 37° to 40° F. over a 15 minute period.

With each of these alarms, the operator can visually monitor a pen recorder chart illustrating the changes in temperature and pressure and thus make a judgment as to when the machine should be shut down or some other action taken.

Although FIGS. 3, 4, 5 and 6 are explained herein in relation to temperature variations, it will be understood that a similar explanation would be given for similar graphs for pressure variations and these graphs should be so considered.

Figure 3:
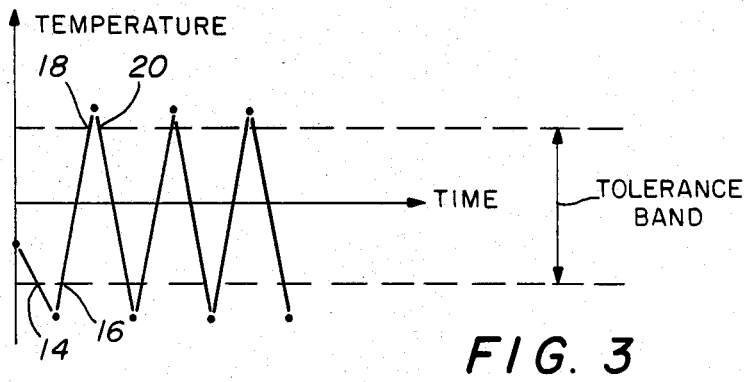
FIG. 3 is a graph illustrating how actual temperature or pressure readings may cycle just outside the acceptable range of temperature and pressure variations.

In FIG. 3, it can be seen that the temperature readings are cycling just outside the acceptable range of temperature variation. It will be noted that whenever the temperature crosses back to within the acceptable range, the timer and monitor will cease function in the present invention. Thus, considering FIG. 3, as the temperature exceeds the acceptable range of variation at point 14, the monitor is activated, the first alarm is sounded and the timer is energized. When the temperature reaches point 16 entering back into the acceptable range of temperature variation, the timer stops and the monitoring ceases. At point 18, the first alarm is sounded and the monitor is activated again as the temperature exceeds the acceptable range. The timer is also again activated. At point 20, as the temperature again enters the acceptable range, the timer stops and monitoring ceases.

Figure 4:
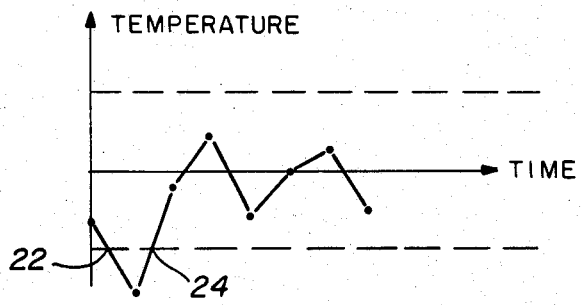
FIG. 4 is a graph illustrating how actual temperature and pressure readings may exceed the acceptable range of variation and then return to within the acceptable range.

In FIG. 4, the temperature readings first exceed the acceptable range of variation of temperature and then return to the acceptable range and remain there. Again, at point 22 as the temperature exceeds the acceptable variation range, the monitor is activated, the first alarm sounded and the timer is started but at point 24 the timer is stopped and the monitor is deactivated as the temperature returns to within the acceptable range.

Figure 5:
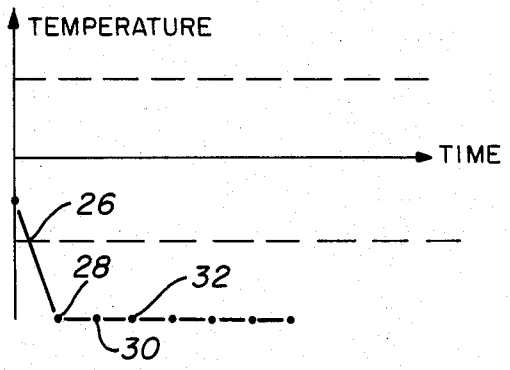
FIG. 5 is a graph illustrating how the temperature or pressure may fall below the acceptable range of variation and remain at that value.

FIG. 5 illustrates the case where the temperature falls below the acceptable range of temperature variation and remains at that value. Thus, at point 26, as the temperature exceeds the acceptable range, the monitor is activated, the first alarm sound and the timer starts. The temperature and rate of change is monitored in five second intervals at points 28, 30, 32 and the like. In this particular case, since the temperature does not change after reaching point 28, no other alarms are sounded but the operator has been alerted.

Figure 6:
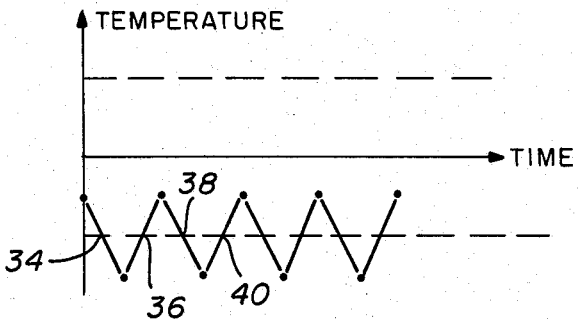
FIG. 6 is a graph illustrating how the temperature or pressure readings may cycle in and out of the acceptable range of variation.

FIG. 6 is a graph illustrating the fluctuations of the temperature readings cycling in and out of the acceptable range of temperature variation. Thus, at point 34, as the temperature exceeds the acceptable range of variation, the monitor is started, the first alarm sounds, and the timing begins. At point 36, as the temperature enters the acceptable range, the monitoring ceases and the timing stops. Again, at point 38, as the temperature exceeds the acceptable range, monitoring begins, the first alarm sounds and the timing starts. At 40, as the temperature re-enters the acceptable range, monitoring ceases and the timer stops. Thus, the first alarm is given each time the temperature exceeds the acceptable range at points such as 34 and 38. This calls the attention of the operator to the temperature variations.

Figure 7:
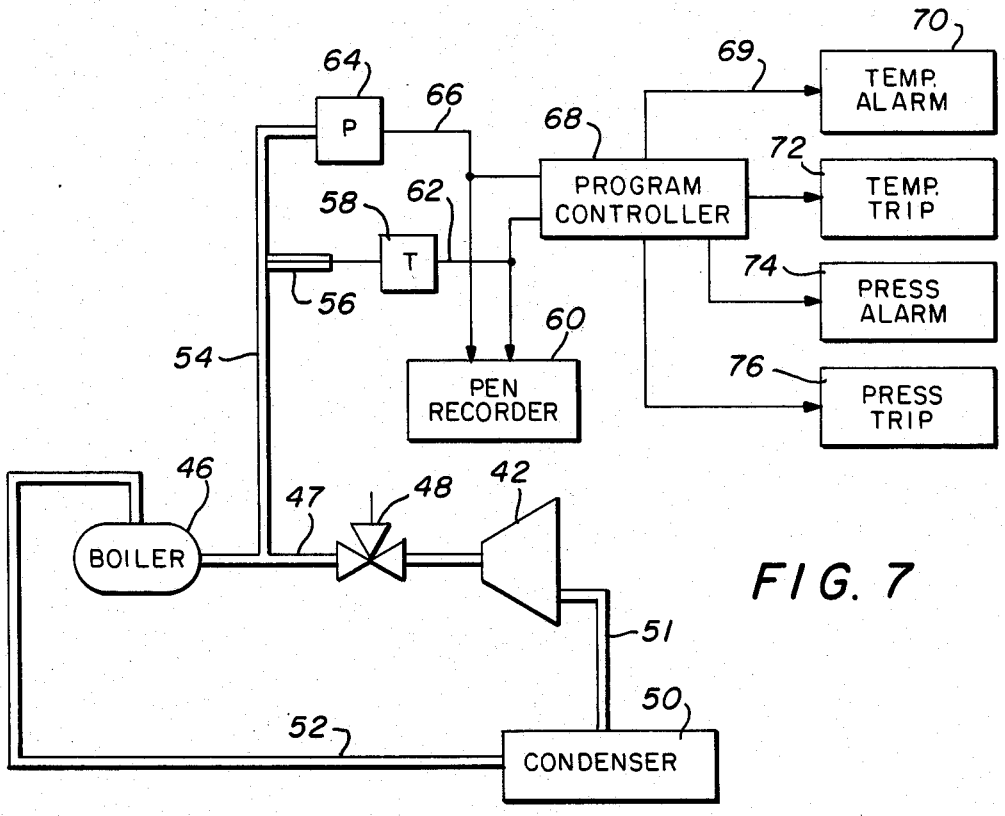
FIG. 7 is a schematic diagram of the present invention illustrating the programmable controller for monitoring pressure and temperature variations and producing output alarms and control signals as necessary if the temperature or pressure exceeds the acceptable range of variation, exceeds an acceptable rate of change of variation, and exceeds a predetermined maximum rate of change of variation.

FIG. 7 illustrates the monitor of the present invention in schematic representation and includes a steam turbine 42 which receives input steam from boiler 46 on line 47 through an input control valve 48. Turbine 42 produces an output on a shaft (not shown). After the steam has given up a substantial part of its thermal energy by expansion in turbine 42, it is transferred through line 51 to condensor 50 where it is condensed to liquid water. The liquid water is returned to boiler 46 through line 52 for further cycling in the system. Control valve 48 is normally a servo controlled valve whose open or closed condition is controlled by some type of mechanical input (not shown).

A portion of the input steam coupled from boiler 46 to control valve 48 on line 47 is coupled through tube 54 to a thermocouple 56 and a pressure transmitter 64. The thermocouple 56 produces an electrical output which, as is well known in the art, depends upon the temperature detected by thermocouple 56. The electrical output of the thermocouple 56 is coupled to a temperature transmitter 58 (well known in the art) which is a two wire transmitter generating from 4 to 20 milliamps depending upon the temperature encountered by thermocouple 56. The output of transmitter 58 is coupled to pen recorder 60 on line 62 and is also coupled to a program controller 68. The pen recorder 60 keeps a visual recording of the temperature variations. The pressure transmitter 64 (well known in the art) also generates a signal in the range of 4 to 20 milliamps depending upon the pressure encountered in conduit 54. This output signal is transmitted on line 66 to pen recorder 60 and to program controller 68. Again, pen recorder 60 makes a visual recording of the pressure variations.

Program controller 68 has within it a reference high temperature limit and low temperature limit which is compared to the signal on line 62 to determine whether or not the actual temperature is within the acceptable range of temperature variation as determined by the high temperature and low temperature limit references. It produces an output on line 69 to alarm 70 if the temperature exceeds the predetermined limits which comprise the acceptable range. When temperature alarm 70 is activated, a clock is started in the program controller 68 which activates a rate of change of temperature device which determines the rate at which the temperature is changing. This rate is compared with a signal representing an acceptable rate of change and if the actual rate is increasing faster than the acceptable rate (which may, for instance, be 25° F. for every 15 minutes), alarm 70 is actuated again.

That same actual rate of change of temperature signal is also compared with a predetermined maximum rate of change allowed which is 37° to 40° F. for each 15 minute time interval and if it exceeds the maximum allowable rate of change, a trip unit 72 is activated which shuts down the turbine and/or a third alarm is actuated which warns the operator of the unacceptable condition that exists. As indicated previously, the predetermined rate of change of temperature normally allowable and the maximum rate of change is compared at 5 second intervals whenever the actual temperature exceeds the predetermined acceptable range of temperatures. If the temperature returns within the normal acceptable range, the clock is deactivated and no comparisons of the rate of change of temperature is made.

In like manner, program controller 68 has predetermined high and low pressure limits set which are coupled to a comparator where the actual pressure is compared with the predetermined acceptable range limits. If the pressure exceeds those range limits, again the clock is activated and a first alarm 74 is activated to indicate that the pressure has exceeded the allowable range limits. The clock which is activated produces an output at 10 second intervals and the clock output enables a rate of change of pressure calculating unit which determines the rate of change of pressure at that instant. That output is coupled to a first comparator which generates a signal representing an acceptable rate of change of pressure which is 45 pounds psi per minute and a second predetermined maximum rate of pressure change which is 66 psi per minute. If the first range is exceeded by the actual pressure, an alarm is tripped or if the maximum rate of pressure change is exceeded either a third alarm is activated and/or the unit is shut down.

Figure 8:
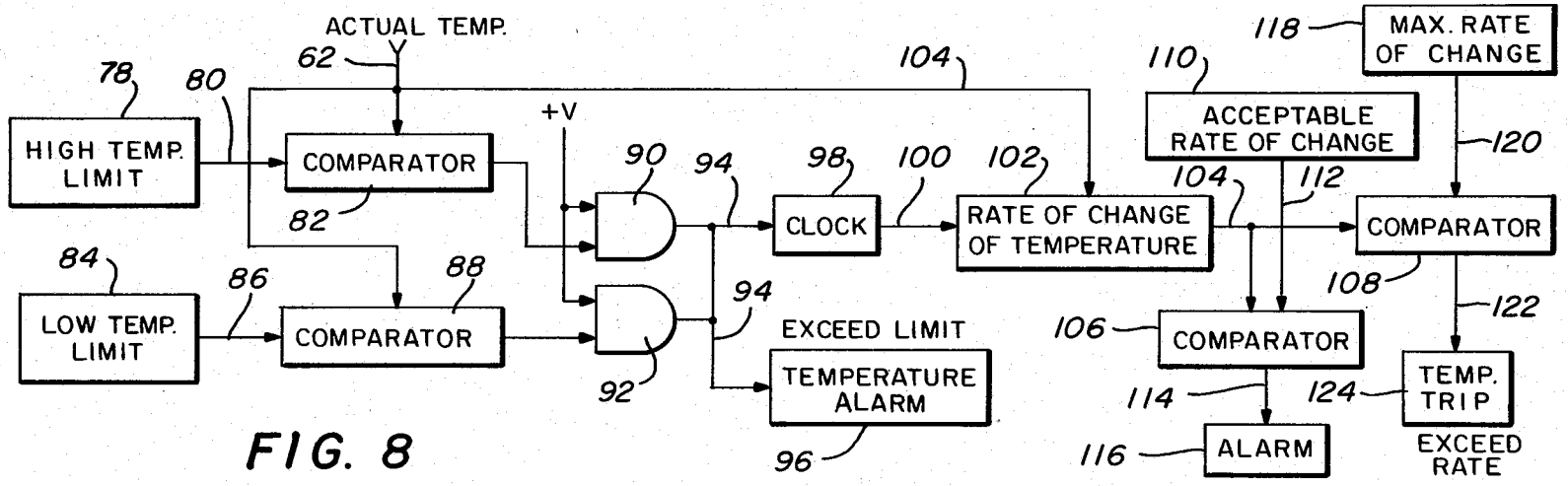
FIG. 8 is a detailed block diagram of one version of the programmable controller for producing the necessary alarm and control signals for temperature variations.

FIG. 8 is a detailed diagram of one circuit for forming the temperature portion of program controller 68 shown in FIG. 7. While the embodiments shown in FIG. 8 and 9 include a combination of analog and digital circuits, it will be understood that various other modifications may be made therein. For example, mechanical sensors, transducers and control devices may be replaced by electrical or electronic equivalents and vice versa. It is intended to include all such modifications as fall within the true spirit and scope of this invention. In addition, instead of preset temperature and pressure limits, lookup tables may be utilized in the form of read only memories, for example, which have the contents of its registers containing predetermined values and the addresses of the registers being the values of pressure and temperature signals supplied to the inputs thereof. Thus, one skilled in the art pertinent to digital or analog programming would be capable of providing a lookup table for satisfying the functional purposes of FIGS. 8 and 9 and no further description of such programming is therefore necessary herein.

As shown in FIG. 8, a predetermined high temperature limit representing the upper portion of an acceptable range of actual temperature variation is generated or stored in any well known manner in unit 78 and coupled through line 80 to a comparator 82. The actual temperature on line 62 from sensor 58 in FIG. 7 is also coupled to comparator 82. In like manner, the low temperature limit of the acceptable range is stored or otherwise predetermined as indicated by block 84 which generates a signal on line 86 that is coupled to a second comparator 88. Thus, comparators 82 and 88 establish the upper and lower limits of an acceptable range of actual temperature variation of the turbine 42. If the actual temperature being coupled to comparators 82 and 88 exceeds or falls out of the range determined by these limits, either AND gate 90 or 92 is energized or activated and an output is produced on line 94 which is coupled to a first alarm 96 and a clock 98. The first alarm 96 merely indicates that the temperature is no longer in the acceptable range. Clock 98 begins to generate output pulses on line 100 at five second intervals. These pulses are coupled to rate unit 102 to activate rate unit 102 which determines the actual rate of change of the temperature on line 104 that is coupled thereto. Such rate of change of temperature unit 102 is old and well known in the art and may be, for example, a derivative circuit which provides a signal output indicative of the time rate of change of the temperature signal. The output of the rate of change of temperature unit 102 on line 104 is an electrical signal representing the actual rate of change of the temperature on line 62 in FIG. 7 and is coupled to first comparator 106 and a second comparator 108. Also coupled to first comparator 106 is a predetermined signal on line 112 from storage device 110 which represents an acceptable rate of change of temperature which may be, for example, 25° F. per 15 minute period for a particular turbine. If the actual rate of change of the steam temperature exceeds the predetermined acceptable rate as determined by the signal stored in device 110, comparator 106 generates an output on line 114 which causes second alarm 116 to be sounded.

In like manner, device 118 stores a predetermined signal representing a maximum rate of change of the steam temperature which may be, for example, 37° to 40° F. per 15 minute period for a particular turbine. This signal is generated on line 120 and is coupled to second comparator 108. If the actual rate of change of temperature exceeds the maximum allowable rate of change as determined by the signal on line 120, comparator 108 generates a signal on line 122 which is coupled to unit 124 which may either be a third alarm or a circuit for shutting down the turbine as necessary.

Therefore, the temperature control circuit shown in FIG. 8 establishes a first alarm if the actual temperature exceeds a predetermined allowable or acceptable range of temperature variation, a second alarm if the temperature has exceeded the acceptable range and, in addition, is exceeding an acceptable rate of change of temperature. It will also sound a third alarm if the rate of change of temperature is exceeding a maximum allowable rate of change. It will be noted, however, that the second alarm 116 and third alarm 124 are generated only when the steam temperature has exceeded the acceptable range of actual temperature variations and the first alarm has sounded.

Figure 9:
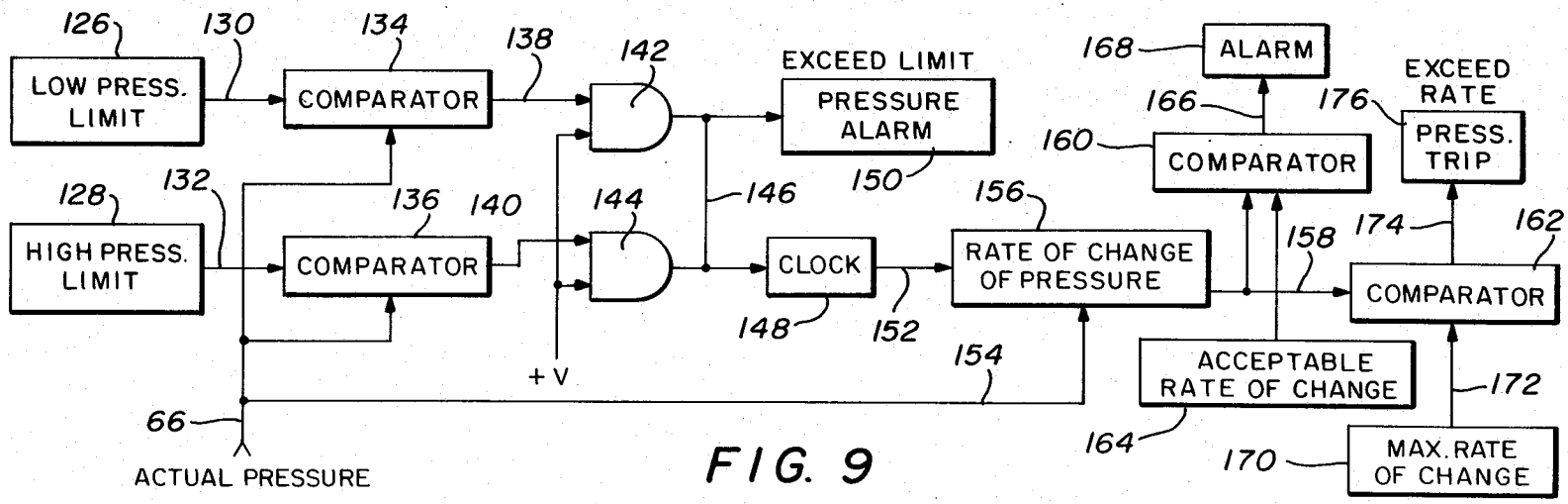
FIG. 9 is a detailed circuit diagram of one version of the programmable controller for producing the necessary alarm and control signals for pressure variations.

In like manner, FIG. 9 illustrates that portion of program controller 68 in FIG. 7 which relates to the pressure control. Again, storage devices 126 and 128 maintain signals representing low and high pressure limits thereby establishing a predetermined acceptable range of actual pressure variations. The outputs of these two devices on lines 130 and 132 respectively are coupled to comparators 134 and 136 respectively. Also coupled to comparators 134 and 136 is a signal on line 66 which represents the actual pressure variations being transmitted by transmitter 64 in FIG. 7. If the actual pressure signal on line 66 indicates that the pressure is exceeding or out of the acceptable range as determined by storage units 126 and 128, either comparator 134 or 136 generates a signal on output lines 138 or 140 respectively which are coupled to AND gates 142 and 144 respectively. AND gates 142 and 144 are activated when a signal appears on respective lines 138 or 140. An output from either of these AND gates 142 or 144 on line 146 is coupled to clock unit 148 and first alarm unit 150. Thus, first alarm unit 150 is sounded only when the actual pressure exceeds the acceptable range of pressure variation as determined by the signals generated by storage units 126 and 128. Further, the clock 148 is energized only when the actual pressure exceeds the acceptable range of pressure variations and then begins to generate pulses at ten second intervals on line 152. The signal representing the actual pressure on line 66 is also coupled on line 154 to a rate of change of pressure calculator 156. Thus, whenever a clock pulse at ten second intervals appears on line 152, rate of change of pressure unit 156 calculates the rate of change of the pressure it is receiving on line 154. Again, this may be done in a well known manner by those skilled in the art utilizing a derivative circuit which provides a signal output which is indicative of the time rate of change of the pressure signal on line 154. Rate of change of pressure unit 156 generates an output signal on line 158 which is coupled to a first comparator 160 and a second comparator 162. Also coupled to the first comparator 160 is a signal from storage unit 164 representing an acceptable rate of change of pressure such as, for example, 45 psi per minute. If the actual rate of change of pressure signal on line 158 from calculator unit 156 exceeds the acceptable rate of change as determined by unit 164, a signal is produced on line 166 to sound second alarm 168. This second alarm 168 thus allows the operator to be aware of the fact that the pressure is increasing faster than an acceptable rate.

Storage unit 170, however, establishes a maximum rate of pressure change allowable which may be, for example, 66 psi per minute and generates a signal on line 172 representing that maximum allowable rate of change. Comparator 162 also looks at the actual rate of change of pressure signal on line 158 and compares it with the maximum allowable rate of change signal on line 172 and if the actual rate of change exceeds the maximum allowable rate, comparator 162 generates an output on line 174 which is coupled to either a third alarm or trip unit 176 which will either sound a third alarm or shut down the turbine as desired.

Thus, the present invention provides a turbine protective system which will monitor not only the rate of change of pressure and temperature but monitors them only when they exceed a predetermined allowable range of pressure variation. Secondly, if the predetermined acceptable range of pressure and temperature variation is exceeded, a first alarm sounds. Only at that point does the monitor begin to function to check the rate of change of variation in both temperature and pressure. If the rate of change exceeds an allowable rate of change, a second alarm sounds. If the rate of change exceeds a maximum allowable rate of change, a third alarm sounds. Thus, the present invention provides a system which allows temperature and pressure variations within an acceptable range thereby avoiding the necessity of continuously monitoring the pressure and temperature at all times under all conditions and thus simplifies for the operator the control of the system. The monitor is therefore effective only when the pressure and temperature variations are outside a normal range and then the rate of change is compared to two different levels; one a normal or acceptable rate of change, and the other a maximum rate of change.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention as defined by the appended claims.

I claim:

1. In a steam turbine being driven from a source of inlet steam, a control system for protecting said turbine from undesirable steam pressure variation comprising:

a. means for establishing an acceptable range of variation of actual steam pressure, b. means coupled to said acceptable pressure range establishing means for generating a first alarm signal only if said actual steam pressure is outside said acceptable range, c. means for generating a second signal representing an acceptable rate of change of said actual pressure, and d. means coupled to said first alarm signal generating means and said second signal generating means for generating a second alarm signal only if the actual rate of change of steam pressure exceeds said acceptable rate of change and said actual steam pressure is outside of said acceptable range of steam pressure variation.

2. A control system as in claim 1 further comprising:

a. means for generating a third signal representing an acceptable maximum rate of change of pressure, and b. means coupled to said first alarm signal generating means and said third signal generating means for generating a third alarm signal only if the actual rate of change of pressure exceeds said maximum rate of change and said actual pressure is outside of said acceptable range of pressure variation.

3. A control system as in claim 2 wherein said first alarm signal generating means comprises:

a. high and low pressure limit signal storing means, and b. a first and a second comparator means coupled to a corresponding one of said high and low limit signal storing means for generating said first alarm signal only if said actual pressure exceeds either of said stored high or low pressure limits.

4. A control system as in claim 3 wherein said second alarm signal generating means comprises:

a. a clock coupled to said first and second comparator means for generating clock signals at predetermined intervals only when said actual pressure is outside of said acceptable range of actual pressure variation, b. means for converting instantaneous values of said actual pressure into corresponding electrical signals, c. means coupled to said converting means and said clock for generating signals representing the rate of change of said actual pressure over a given period of time, and d. third comparator means for receiving said second signal representing said acceptable rate of change of pressure and said rate of change of actual pressure signals whereby said second alarm signal is generated only if said rate of change of actual pressure exceeds said acceptable rate of change of pressure and said actual pressure is outside said acceptable range of pressure variation.

5. A control system as in claim 4 wherein said third alarm signal generating means comprises fourth comparator means for receiving said signals representing said rate of change of actual pressure and said third signal representing said maximum acceptable rate of change of pressure and generating said third alarm signal only if said rate of change of actual pressure exceeds said maximum acceptable rate of change of pressure and said actual pressure is outside said acceptable range of pressure.

6. A control system as in claim 5 wherein said clock generates a clock pulse every ten seconds only when said actual pressure is outside of said acceptable range of pressure thereby enabling a determination of the actual rate of change of pressure to be made every 10 seconds.

7. In a steam turbine being driven from a source of inlet steam, an improved method of control for protecting said turbine from undesirable steam pressure variation comprising the steps of:

a establishing an acceptable range of variation of actual steam pressure, b. generating a first alarm signal only if said actual pressure is outside of said acceptable range, c. generating a second signal representing an acceptable rate of change of said actual pressure, and d. generating a second alarm signal only if the actual rate of change of pressure exceeds said acceptable rate of change and said actual pressure is outside of said acceptable range of pressure variation.

8. A method as in claim 7 further comprising the steps of:

a. generating a third signal representing an acceptable maximum rate of change of pressure, and b. generating a third alarm signal only if the actual rate of change of pressure exceeds said maximum rate of change and said actual pressure is outside of said acceptable range of pressure variation.

9. A method as in claim 8 wherein the step of generating said first alarm signal further comprises the steps of:

a. establishing predetermined high and low pressure limit signals representing an acceptable range of pressure variation, and b. coupling first and second comparators to a corresponding one of said high and low pressure limit signals for generating an alarm signal only if said actual pressure exceeds either said high or low pressure signal limits.

10. a method as in claim 9 wherein said step of generating said second alarm signal comprises the steps of:

a. coupling a clock to said first and second comparators for generating clock signals at predetermined intervals only when said actual pressure is outside of said acceptable range of pressure variations, b. converting instantaneous values of said actual steam pressure into corresponding electrical signals, c. generating signals representing the actual rate of change of steam pressure over a given period of time, d. coupling said signals representing said acceptable rate of change of pressure and said actual rate of change pressure to a third comparator such that said second alarm signal is generated only if said actual rate of change of steam pressure exceeds said allowable rate of change of pressure and said actual pressure is outside of said acceptable range of pressure variation.

11. A method as in claim 10 further comprising the step of providing a fourth comparator for receiving said signals representing said actual rate of change of steam pressure and said third signal representing said maximum acceptable rate of change of pressure and generating said third alarm signal only if said actual rate of change of pressure exceeds said maximum acceptable rate of change of pressure and said actual pressure is outside of said acceptable range of pressure variation.

12. A method as in claim 11 further comprising the step of generating a clock pulse every ten seconds only when said actual pressure is outside of said acceptable range of pressure variation thereby enabling a determination of the actual rate of change of pressure to be made every ten seconds.

13. In a steam turbine being driven from a source of inlet steam, a control system for protecting said turbine from undesirable steam temperature variation comprising:

a. means for establishing an acceptable range of variation of actual steam temperature, b. means coupled to said acceptable temperature range establishing means for generating a first alarm signal only if said actual steam temperature is outside of said acceptable range, c. means for generating a second signal representing an acceptable rate of change of said actual temperature, and d. means coupled to said first alarm signal generating means and second signal generating means for generating a second alarm signal only if the actual rate of change of steam temperature exceeds said acceptable rate of change and said actual steam temperature is outside of said acceptable range of steam temperature variation.

14. A control system as in claim 13 further comprising:

a. means for generating a third signal representing an acceptable maximum rate of change of temperature, and b. means coupled to said first alarm signal generating means and said third signal generating means for generating a third alarm signal only if the actual rate of change of temperature exceeds said maximum rate of change and said actual temperature is outside of said acceptable range of temperature variation.

15. A control system as in claim 14 wherein said first alarm signal generating means comprises:

a. high and low temperature limit signal storing means, and b. a first and a second comparator means coupled to a corresponding one of said high and low limit temperature signal storing means for generating said first alarm signal only if said actual temperature exceeds either of said stored high or low pressure temperature stored limits.

16. A control system as in claim 15 wherein said second alarm signal generating means comprises:

a. a clock coupled to said first and second comparator means for generating clock signals at predetermined intervals only when said actual temperature is outside of said acceptable range of temperature variation, b. means for converting instantaneous values of said actual temperature into corresponding electrical signals.

c. means coupled to said converting means and said clock for generating signals representing the rate of change of said actual temperature over a given period of time, and d. third comparator means for receiving said second signal representing said acceptable rate of change of temperature and said actual rate of change of temperature signals whereby said second alarm signal is generated only if said actual rate of change of temperature exceeds said acceptable rate of change of temperature and said actual temperature is outside said acceptable range of temperature variation.

17. A control system as in claim 16 wherein said third alarm signal generating means comprises fourth comparator means for receiving said signal representing said rate of change of actual temperature and said third signal representing said maximum acceptable rate of change of temperature and generating said third alarm signal only if said actual rate of change of temperature exceeds said maximum acceptable rate of change of temperature and said actual temperature is outside said acceptable range of temperature variation.

18. A control system as in claim 17 wherein said clock generates a clock pulse every five seconds only when said actual temperature is outside of said acceptable range of temperature thereby enabling a determination of the actual rate of change of temperature to be made every five seconds.

19. In a steam turbine being driven from a source of inlet steam, a method of protecting said turbine from undesirable steam temperature variations comprising the steps of:

a. establishing an acceptable range of variation of actual steam temperature, b. generating a first alarm signal only if said actual temperature is outside of said acceptable range, c. generating a second signal representing an acceptable rate of change of said actual temperature, and d. generating a second alarm signal only if the actual rate of change of temperature exceeds said acceptable rate of change and said actual temperature is outside of said acceptable range of temperature variation.

20. A method as in claim 19 further comprising the steps of:

a. generating a third signal representing an acceptable maximum rate of change of temperature, and b. generating a third alarm signal only if the actual rate of change of temperature exceeds said maximum rate of change and said actual temperature is outside of said acceptable range of temperature variation.

21. A method as in claim 20 wherein the step of generating said first alarm signal further comprises the steps of:

a. establishing predetermined high and low temperature limit signals representing an acceptable range of temperature variation, and b. coupling first and second comparators to a corresponding one of said high and low temperature limit signals for generating an alarm signal only if said actual temperature exceeds either of said predetermined high or low temperature signal limits.

22. A method as in claim 21 further comprising the steps of:

a. coupling a clock to said first and second comparators for generating clock signals at predetermined intervals only when said actual temperature is outside of said acceptable range of temperature variation, b. converting instantaneous values of said actual steam temperature into corresponding electrical signals, c. generating signals representing the actual rate of change of steam temperature over a given period of time, and d. coupling said signals representing said acceptable rate of change of temperature and said actual rate of change of temperature to a third comparator for generating said second alarm signal only if said actual rate of change of temperature exceeds said allowable rate of change of temperature and said actual temperature is outside of said acceptable range of temperature variation.

23. A method as in claim 22 further comprising the step of providing a fourth comparator for receiving said signals representing said actual rate of change of steam temperature and said third signal representing said maximum acceptable rate of change of temperature and generating said third alarm signal only if said actual rate of change of temperature exceeds said maximum acceptable rate of change of temperature and said actual temperature is outside of said acceptable range of temperature variation.

24. A method as in claim 23 further comprising the step of generating a clock pulse every five seconds only when said actual temperature is outside of said acceptable range of temperature variation thereby enabling a determination of the actual rate of change of temperature to be made every five seconds.

* * * * *